US012495829B2

(12) United States Patent
Loveday

(10) Patent No.: US 12,495,829 B2
(45) Date of Patent: Dec. 16, 2025

(54) CARTOMIZER FOR AN AEROSOL GENERATING DEVICE WITH COMBINED ELECTRICAL AND MAGNETIC CONTACTS

(71) Applicant: JT International SA, Geneva (CH)

(72) Inventor: Peter Loveday, Epsom (GB)

(73) Assignee: JT International SA (CH)

( * ) Notice: Subject to any disclaimer, the term of this patent is extended or adjusted under 35 U.S.C. 154(b) by 481 days.

(21) Appl. No.: 18/024,655

(22) PCT Filed: Sep. 1, 2021

(86) PCT No.: PCT/EP2021/074122
§ 371 (c)(1),
(2) Date: Mar. 3, 2023

(87) PCT Pub. No.: WO2022/049118
PCT Pub. Date: Mar. 10, 2022

(65) Prior Publication Data

US 2023/0263219 A1 Aug. 24, 2023

(30) Foreign Application Priority Data

Sep. 4, 2020 (EP) ..... 20194595

(51) Int. Cl.
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
CPC ..... A24F 40/40; A24F 40/10
See application file for complete search history.

(56) References Cited

U.S. PATENT DOCUMENTS

2014/0290677 A1 10/2014 Liu
2015/0305409 A1* 10/2015 Verleur ..... A24F 40/50 131/329
2020/0107583 A1* 4/2020 Wu ..... A24F 47/00

FOREIGN PATENT DOCUMENTS

EP 3560362 A1 10/2019
EP 3636083 A1 4/2020

OTHER PUBLICATIONS

International Search Report for Application No. PCT/EP2021/074122 mailed Nov. 16, 2021, pp. 1-3.

* cited by examiner

*Primary Examiner* — Michael H. Wilson
*Assistant Examiner* — Jennifer A Kessie
(74) *Attorney, Agent, or Firm* — Lerner David LLP

(57) ABSTRACT

A cartomizer for an aerosol generating device includes a first end configured to engage with a control and power supply device, and a second end having a vapor outlet; a container for holding a reservoir to contain vaporizable material, and a vaporizing unit including an electrical heating element and a liquid transport element. The liquid transport is arranged to deliver vaporizable material from the reservoir to the heating element, a bottom holder and a pair of electrodes held by the bottom holder at the first end of the cartomizer. The electrodes are made of a ferrous or ferro-magnetic material and extend transversally at the bottom holder so that each electrode forms a first portion of contact with an electrical contact of the control and power supply device and a second portion of contact adjacent the first portion of contact to engage with a magnetic element of the power device.

15 Claims, 4 Drawing Sheets

CARTOMIZER FOR AN AEROSOL GENERATING DEVICE WITH COMBINED ELECTRICAL AND MAGNETIC CONTACTS

CROSS-REFERENCE TO RELATED APPLICATIONS

The present application is a national phase entry under 35 U.S.C. § 371 of International Application No. PCT/EP2021/074122, filed Sep. 1, 2021, published in English, which claims priority to European Application No. 20194595.3 filed Sep. 4, 2020, the disclosures of which are incorporated herein by reference.

CROSS REFERENCE

Any features essential to the European patent applications titled "CARTOMIZER FOR AN AEROSOL GENERATING DEVICE WITH FINS" and "CARTOMIZER FOR AN AEROSOL GENERATING DEVICE WITH LEAKAGE PREVENTION" all filed Sep. 4, 2020 having application numbers 20 194 596.1 and 20 194 597.9, as well as the corresponding PCT applications all filed Sep. 1, 2021, such as the claims thereof, and/or contained therein and corresponding to and/or relating to features of the present application are incorporated herein by this reference and can be combined with feature combinations disclosed herein in order to provide an improved aerosol generating device, and protection may be sought for the resulting feature combinations.

TECHNICAL FIELD

The present invention relates to a cartomizer for an aerosol generating device, in particular an electronic cigarette or vaporizer, with combined electrical and magnetic contacts.

TECHNICAL BACKGROUND

Aerosol generating devices, such as electronic cigarettes or "e-cigarettes" as they are also known, have gained in popularity over the past ten years as an alternative to traditional smoking articles, like cigarettes, cigars, and cigarillos. Developments in the design and configuration of such aerosol generating devices or vaporizer devices are on-going to improve their performance and their reliability, as well as their ease of production and their production costs.

Conventional aerosol generating devices usually include a heater powered by an electrical power source and a liquid reservoir containing flavoured liquid (vaporizable material) that can be volatized using the heater and transferred to a user of the aerosol generating device in an airflow, which is preferably guided through a mouthpiece of the device.

In order to provide a convenient way for a user to load the vaporizable material into the aerosol generating device and to avoid the need for the user to handle the vaporizable material (liquid) directly, thereby reducing the likelihood of spillage and waste, conventionally exchangeable capsules are provided. In this way, the integrity, safety and quality of the vaporizable material can also be assured, because it is loaded into the shell or container during manufacture to form a pre-manufactured capsule. Correct dosing of the vaporizable material is also assured.

Moreover, in order to avoid that the heating element is worn out over time, the heating element is often provided within the capsule, thereby forming a so called "cartomizer".

As the heating element (heater) is provided with the cartomizer, it is each time the cartomizer (capsule) is replaced, hence, there is no reduction in performance over time.

However, since the cartomizer or capsule is replaceable, there is a need of contacts configured to provide the heating element of the cartomizer with electrical power. Moreover, conventionally a separate ferrous cover is provided over the lower housing of the cartomizer, in order to allow magnets arranged in the aerosol generating device to retain the cartomizer.

Additionally, since in general a liquid transport element, in particular a wick, is used to transport the vaporizable material to the heater, in particular a coil that is wound around the wick, it is unavoidable that vaporizable material (liquid) leaks from the reservoir via the liquid transport element into the vaporization chamber and thereby into the air path of the cartomizer. Accordingly, it is necessary to provide the contacts between the cartomizer and the aerosol generating device with seals, preventing that leaked vaporizable material or liquid affects either the device or consumer. Hence, known contact arrangements of cartomizers involve several separate elements, increasing manufacturing and material costs while having a high risk of potential leakage of the vaporizable material.

U.S. Pat. No. 9,737,093 B2 is related to an electronic cigarette comprising from a first vaping end and a second end distal from the user's mouth, a cartridge, a vaporizer and a battery. It is further disclosed to provide a circular chamber that has direct access to the vaporizing chamber in order to collect leaking vaporizable material. A similar device is shown in US 2019/0335813 A1. The described device includes an atomizer provided with a base seat mounted on the lower end of a liquid storage tube, an electrode and a sealing member.

SUMMARY OF THE INVENTION

In view of the above, there is the desire to provide a cartomizer for an aerosol generating device, in particular an electronic cigarette or vaporizer, capable of reducing the necessary parts of a contact arrangement of the cartomizer, thereby reducing the risk of a potential leakage of vaporizable material and reducing the required manufacturing and material costs while increasing the aesthetic appeal of the product. A further object of the present invention is to reduce the number of metal pieces in the cartomizer and to remove the need for a separate ferrous cover while avoiding movement of the electrical heating element and the liquid transport element (wick).

This aim may be achieved by a cartomizer as defined in claim 1 and an aerosol generating device as defined in claim 11. Embodiments may be found in the dependent claims, the following description and the accompanying drawings.

According to one embodiment of the present invention, there is provided a cartomizer for an aerosol generating device, in particular an electronic cigarette or vaporizer, the cartomizer including: a first end configured to engage with a control and power supply device, in particular of the aerosol generating device, and a second end having a vapor outlet; the cartomizer further including: a container for holding at least one reservoir configured to contain vaporizable material, a vaporizing unit comprising an electrical heating element and a liquid transport element, wherein the liquid transport element is arranged to deliver vaporizable material or liquid from the at least one reservoir to the heating element, a bottom holder and a pair of electrodes held by the bottom holder at the first end of the cartomizer, wherein the pair of electrodes are made of a ferrous or ferro-magnetic material and are configured to extend transversally, in particular with regard to the container of the cartomizer, at the bottom holder so that each electrode forms a first portion of contact with an electrical contact of the control and power supply device and a second portion of contact adjacent the first portion of contact to engage with a magnetic element of the control and power device.

Hence, a cartomizer for an aerosol generating device is provided, capable of reducing the necessary parts of a contact arrangement of the cartomizer used for providing the electrical heating element of the cartomizer with electrical power. Thereby, reducing the likelihood that vaporizable material or liquid leaking from the liquid transport element or a heater of the cartomizer reaches the outside of the cartomizer. Thereby, ensuring that leaked vaporizable material or liquid is prevented from affecting the device or a user of the device. Moreover, by reducing the number of necessary parts, making it possible to reduce manufacturing and material costs, while increasing the aesthetic appeal of the product.

According to a further embodiment of the present invention, the pair of electrodes may extend along substantially 75% of, preferably a full transversal length of the bottom holder.

Moreover, in some embodiments of the present invention, the bottom holder may include an air inlet communicating with the vaporizing unit and each electrode may be positioned at opposite sides of the air inlet.

Furthermore, the electrodes may extend in the direction of the larger transversal dimension of the bottom holder. Said transversal dimension of the bottom holder is in particular arranged orthogonal to an axial direction of the cartomizer.

As regards the "axial direction of the cartomizer", said direction defines in the present application in general a longitudinal direction of the cartomizer. However, as the shape of the cartomizer might vary, the "axial direction of the cartomizer" also refers to a direction in which the air flows in general through the cartomizer, namely from an air inlet of the cartomizer to a mouth end (second end) of the cartomizer, which is configured to come into contact with the lips of a user during use of the aerosol generating device.

Moreover, in some embodiments, the electrodes may extend at least partially at the surface, in particular at the bottom outside surface, of the bottom holder. Said surface is arranged on the first end of the cartomizer and faces the outside of the cartomizer.

Additionally, the electrodes may be fixed in a stationary manner in the bottom holder.

Furthermore, the electrodes may be at least partially embedded in the bottom holder. In this way it becomes possible to eliminate the need of additional sealing elements around the contacts while also removing the chance of these seals to fail. In this way it becomes possible to absorb holding forces, which act on the pair of electrodes when retaining the cartomizer with magnetic elements implemented into the aerosol generating device, by the bottom holder of the cartomizer. Thereby, reducing the likelihood that the strong holding forces can create a movement of the heating element and liquid transport element (wick) resulting in leakage of vaporizable material and negatively affecting consumer's experience.

Moreover, the electrodes may be formed of flat elements, in particular plated ferrous material pressings. By fabricating the electrodes out of plated ferrous material pressings, it becomes possible to increase conductivity and prevent corrosion.

Furthermore, in some embodiments, the bottom holder is at least partially overmoulded on the electrodes. The bottom holder may be made of injected plastic such as polypropylene, PA, PET or PEEK.

In some embodiments, each of the electrodes may further form a third portion of contact, which is preferably arranged orthogonal to the first and second portions of contact, configured to contact lead wires providing the electrical heat element with electrical power, in particular with electrical power from the control and power supply device of the aerosol generating device.

According to a further embodiment of the present invention, an aerosol generating device, in particular an electronic cigarette or vaporizer, is provided, including: a control and power supply device including a cartomizer receiving seat with electrical contacts and at least one magnetic element transversally separate from the electrical contacts and a cartomizer according to any of the preceding claims, wherein when the cartomizer is received in the receiving seat of the device, the first portion of the electrodes of the cartomizer contacts the electrical contacts of the device and the second portion of at least one of the electrodes engages the at least one magnetic element of the device.

Furthermore, in some embodiments, the receiving seat may include a pair of electrical contacts and a pair of magnetic elements and when the cartomizer is received in the cartomizer receiving seat, the first and second portions of the electrodes of the cartomizer respectively contacts/engages one electrical contact and one magnetic element of the device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DETAILED DESCRIPTION

Figure 1:
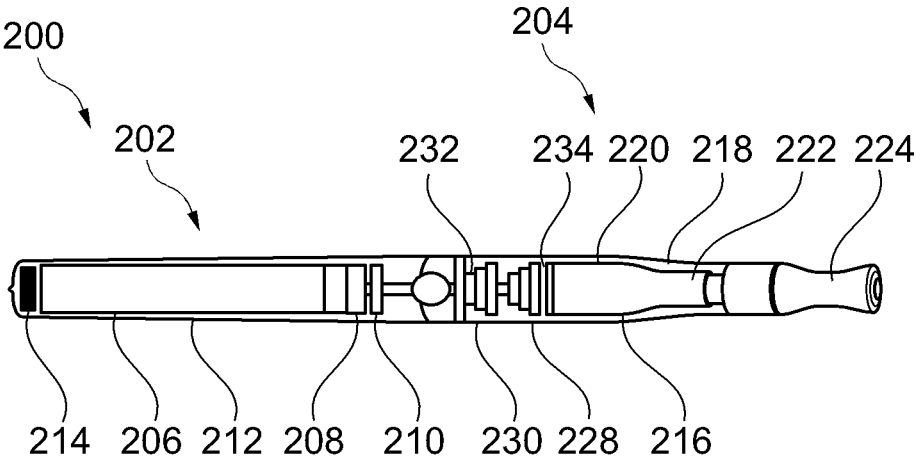
Fig. 1 ( Prior Art )
FIG. 1 shows a sectional view of a conventional aerosol generating device having a housing consisting of a control body and a tank.

Embodiments of the present disclosure will now be explained with reference to the drawings. It will be apparent to those skilled in the field of aerosol generating devices from this disclosure that the following description of the embodiments is provided for illustration only and not for the purpose of limiting the disclosure as defined by the appended claims. Features of the embodiments described below can also be used to further characterize the device defined in the claims.

Modifications of features can be combined to form further embodiments. Features described in individual embodiments can be provided in a single embodiment if they are not incompatible. Likewise, features described in a single embodiment can be provided in several embodiments individually or in any suitable sub-combination. As used in the specification and the appended claims, the singular forms "a", "an", "the" and the like include plural referents unless the context clearly dictates otherwise.

The same reference numerals listed in different figures refer to identical, corresponding or functionally similar elements.

As described hereinafter, example implementations of the present disclosure relate to cartomizers for aerosol generating devices or aerosol delivery devices. Aerosol generating devices according to the present invention use electrical energy to heat a material (preferably without combusting the material to any significant degree and/or without significant chemical alteration of the material) to form an inhalable substance or vapor; and components of such device have the form of articles that most preferably are sufficiently compact to be considered hand-held devices. That is, use of components of preferred aerosol generating devices does not result in the production of smoke in the sense that aerosol results principally from by-products of combustion or pyrolysis of tobacco, but rather, use of those devices preferably results in the production of vapors resulting from volatilization or vaporization of certain components incorporated therein.

In some example implementations, components of aerosol generating devices may be characterized as electronic cigarettes, and those electronic cigarettes preferably incorporate aerosolisable liquid (e.g. propylene glycol, polyhydric alcohol), tobacco and/or tobacco materials derived at least partially from tobacco, and hence deliver tobacco derived components in aerosol or vapor form to a user. In more detail, aerosol generating devices within the meaning of the present invention may transport the volatilized particles in an airflow through the aerosol generating device, in particular through the cartomizer, to a user of the device, the user of the device being able to activate or deactivate the generation of aerosol and to control the duration, velocity and volume of the airflow by means of puffing or inhaling action.

FIG. 1 illustrates a known aerosol generating or delivery device 200 including a control body 202 and a tank 204. As shown in FIG. 1, the control body 202 can be formed of a control body shell 206 that can include a control component 208 (e.g., a printed circuit board (PCB), an integrated circuit, a memory component, a microprocessor, individually or as part of a micro-controller, and the like), a flow sensor 210, a battery 212, and one or more light-emitting diodes (LEDs) 214, and such components can be variably aligned. Moreover, the tank 204 can be formed of a tank shell 216 enclosing a reservoir 218 that is in fluid communication with a liquid transport element 220 adapted to wick or otherwise transport an aerosol precursor composition stored in the reservoir housing to a heater 222 (sometimes referred to as a heating element). A valve may be positioned between the reservoir and heater and configured to control an amount of aerosol precursor composition passed or delivered from the reservoir to the heater. The known device is provided with a mouthpiece 224 having an opening defined therein and which may be coupled to the tank shell 216 to allow for egress of formed aerosol from the tank 204. The shown device 200, in particular the control body 202 and the tank 204, include a coupler 230 having a cavity 232 therein. A base 228 of the tank is adapted to engage the coupler and includes a projection 234 to fit within the cavity.

Aerosol generating devices of the present invention generally include a number of components provided within an outer body or shell, which may be referred to as an outside casing or housing. The overall design of the outside casing can vary, and the format or configuration of the outside casing that can define the overall size and shape of the aerosol generating device can vary. For some aerosol generating devices, an elongated body resembling the shape of a cigarette or cigar can be formed from a single, unitary housing, or the elongated housing can be formed of two or more separable bodies. For example, an aerosol generating device can include an elongated shell or body (outside casing) that can be substantially tubular in shape and, as such, resemble the shape of conventional cigarettes or cigars. In one implementation, all of the components of the aerosol generating device are contained within a single housing. Alternatively, an aerosol delivery device can comprise two or more housings that are joined and are separable.

Aerosol generating devices of the present invention can be formed of an outside casing or shell that is not substantially tubular in shape but may be formed to substantially greater transversal dimensions. The outside casing or shell can be configured to include a mouthpiece and/or may be configured to receive a separate shell (e.g. a cartridge, a tank) that can include consumable elements, such as a liquid aerosol former, and can include a vaporizer.

Figure 2:
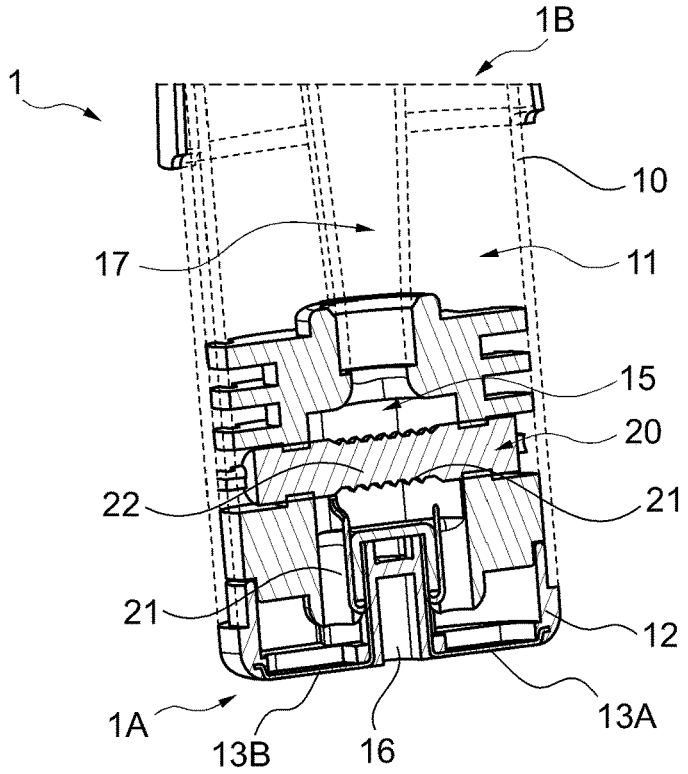
FIG. 2 shows a schematic sectional view of the interior of a cartomizer for an aerosol generating device according to a first embodiment of the present invention.

FIG. 2 shows a schematic sectional view of the interior of a cartomizer 1 for an aerosol generating device 100 according to a first embodiment of the present invention. As can be taken from FIG. 2, the cartomizer 1 is generally a container 10 or cartridge that can be at least partially inserted into a receiving cavity or cartomizer receiving seat of an aerosol generating device and that provides the functionalities of generating an aerosol or vapor from a vaporizable material or liquid stored therein. For example, a cartomizer can be a pre-manufactured and pre-filled cartridge that comprises at least one reservoir 11 for containing the vaporizable material or liquid from which the aerosol or vapor can be generated. For the purpose of generating said aerosol or vapor, the cartomizer 1 may further comprise a vaporizing unit 20 including a heater or electrical heating element 21 which is arranged to heat at least a fraction of the vaporizable material or liquid so as to vaporize an amount of it for, in turn, generating the aerosol or vapor. The heater or electrical heating element 21 may comprise any one and/or a combination of a wire, a resistive element, a coil, and a susceptor being heatable by induction. The cartomizer 1 further comprises an air conduct and/or a mouthpiece (second end) 1B so as to allow a user to inhale the generated aerosol, preferably as a mixture with air from the environment.

In the shown embodiment the electrical heating element 21 is formed by a wire that is wound around a liquid transport element 22, in particular a capillary-type wick such as a bundle of cotton filaments, and located within a vaporizing chamber 15. It should further be mentioned that the vaporizing chamber 15 is fluidly connected to the mouth end or second end 1B, in particular an opening provided in the second end 1B, via a vapor passage 17. In other words, vapor generated by the heater can be provided via the vapor passage 17 and the opening in the mouth end or second end 1B to a user. In the shown embodiment the cartomizer 1 is only provided with one reservoir 11 which surrounds the vapor passage 17, the heater and the liquid transport element 22. Both ends of the liquid transport element 22 or wick reach into the reservoir 11, in particular into the vaporizable material stored inside the reservoir 11, on opposing sides and thereby convey, wick or otherwise transport the vaporizable material from the reservoir 11 to the heater which is positioned inside the vaporizing chamber 15.

As also can be seen in FIG. 2, the cartomizer 1 is provided with an air inlet 16 which is arranged on the bottom, in particular in a bottom holder 12, of the container 10. The air inlet 16 is configured to supply the vaporizing chamber 15 with ambient air, which is sucked into the vaporizing chamber 15 during use of the aerosol generating device 100.

Moreover, the cartomizer 1 is provided with a first end 1A that is configured to engage with a control and power supply device 100 of the aerosol generating device. FIG. 2 further shows that the cartomizer 1 is provided with a pair of electrodes 13A, 13B held by the bottom holder 12 at the first end 1A of the cartomizer 1. It should also be noted that the pair of electrodes 13A, 13B extends transversally with regard to the container 10 of the cartomizer 1 at the bottom holder 12. In other words, the pair of electrodes 13A, 13B extends horizontally or in the right and left direction of FIG. 2. Accordingly, at least a major part of the electrodes 13A, 13B extends parallel to the liquid transport element 22. Each of the electrodes 13A, 13B forms a first portion of contact 14A (shown in FIG. 5) and a second portion of contact 14B. The first and second portion of contact 14A, 14B are arranged in the transversal direction adjacent to each other. The first portion of contact 14A is arranged to come into contact with an electrical contact of the control and power supply device 101 when inserted into the aerosol generating device 100, in particular into a cartomizer receiving seat 104 of the aerosol generating device 100. Each second portion of contact 14B, which is arranged further outside than the first second portion, in other words closer to the container or shell 10 of the cartomizer 1, is arranged to engage with a magnetic element 103 provided in the aerosol generating device 100. For this, a pair of magnetic elements 13 is preferably arranged in the device. It should be further noted that the pair of electrodes 13A, 13B extends along almost the full transversal length of the bottom holder 12. In other words, the transversal length of both of the electrodes 13A and 13B in the transversal direction of the bottom holder 12, which is the larger transversal dimension of the bottom holder 12, is almost the same length as the transversal length of the bottom holder 12. As a result, the surface in magnetic contact with the magnetic elements can be sufficiently large and the magnetic elements can be of sufficient size to provide an effective magnetic fastening of the cartomizer in the device.

Figure 3:
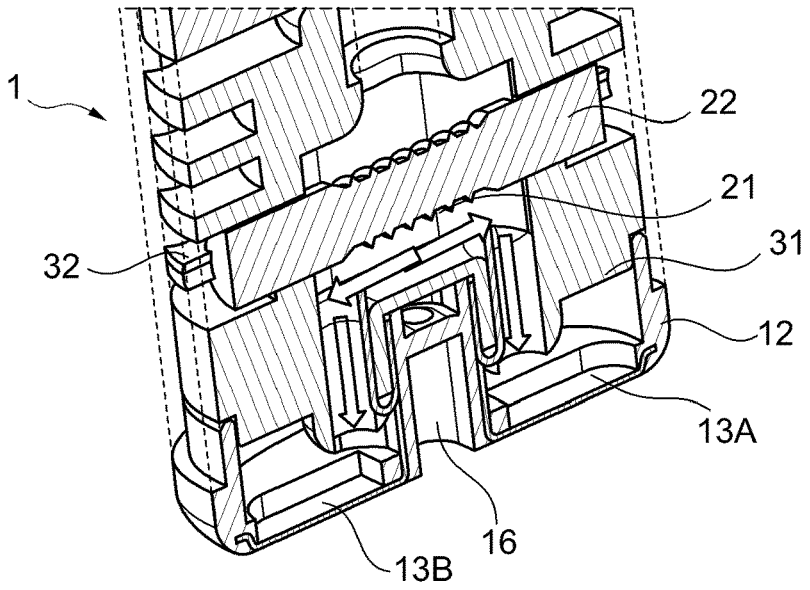
FIG. 3 shows a schematic sectional view of a detail of the device shown in FIG. 2.

As can be taken from FIG. 3, which shows a schematic sectional view of a detail of the cartomizer 1 shown in FIG. 2, the air inlet 16 provided in the bottom holder 12 is arranged to provide ambient air to the vaporizing unit 20, in particular the electrical heating element 21 arranged in the vaporizing chamber 15. It should also be noted that the two electrodes, in particular the right electrode 13A and the left electrode 13B seen in FIGS. 2 and 3, are provided on opposite sides of the air inlet 16, which may be provided in the center of the bottom holder 12. It should be further noted that the cartomizer 1 is provided with a first sealing 31 or holding element which is provided to hold the liquid transport element 22 or wick in its axial position. Moreover, the cartomizer 1 is further provided with a second sealing 32 that radially surrounds the liquid transport element 22, hence, holds the liquid transport element 22 in its radial position within the container 10.

Figure 4:
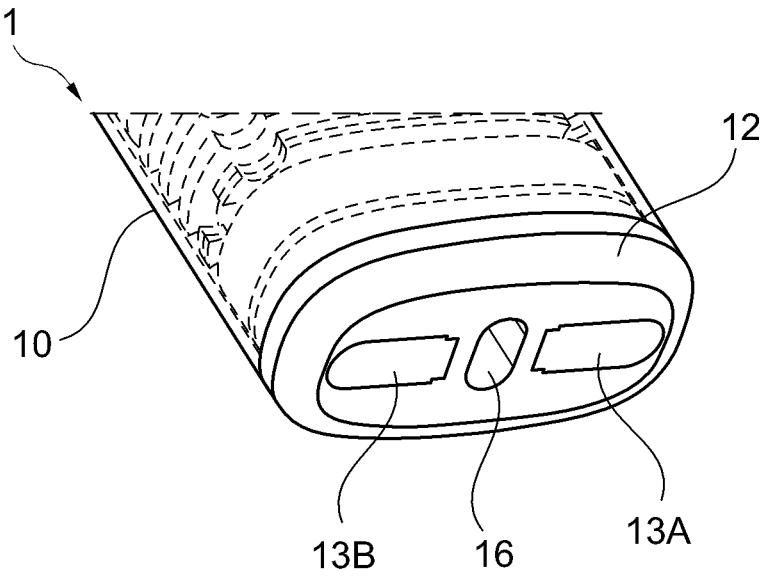
FIG. 4 shows a schematic spatial bottom view of the cartomizer shown in FIG. 2.
Figure 5:
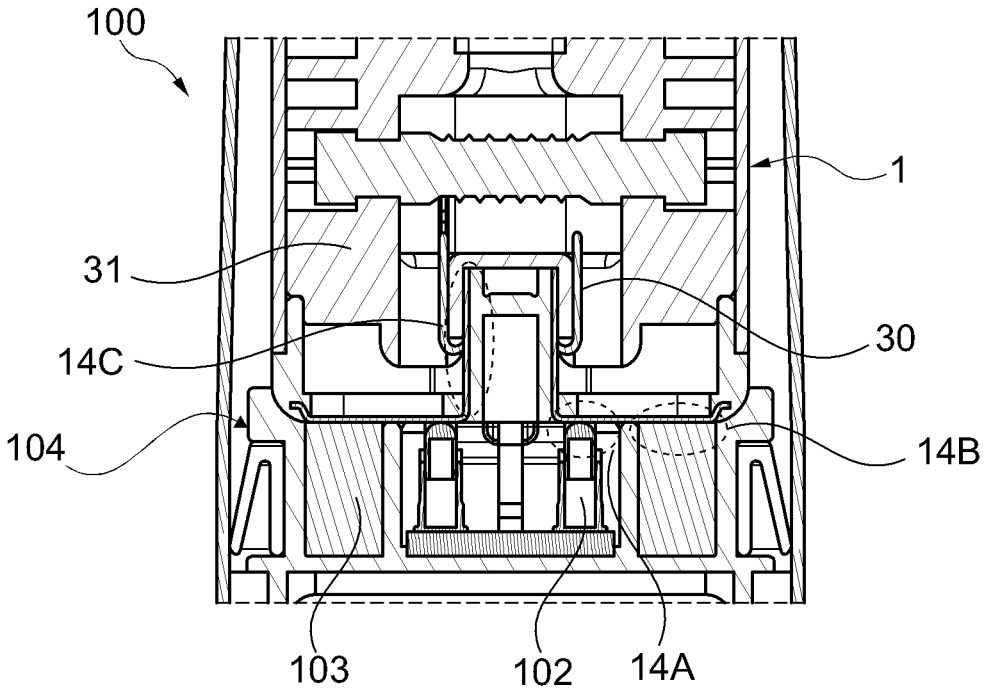
FIG. 5 shows a schematic sectional view of a detail of the device shown in FIG. 2 when inserted into an aerosol generating device.

FIG. 4 shows a schematic spatial bottom view of the cartomizer 1 shown in FIG. 2. As can be taken from FIG. 4, the electrodes 13A, 13B extend partially at the surface 12A of the bottom holder 12. In other words, the electrodes 13A, 13B are at least partially exposed to the outside. Meaning, the electrodes 13A, 13B are not fully encapsulated or embedded in the bottom holder 12. Thereby, making it possible (as shown in FIG. 5) that two electrical contacts 102 of the aerosol generating device electrically contact the two electrodes 13A, 13B. In this way the control and power device 101 of the aerosol generating device 100 can provide electrical power from a battery 105 of the device 100 to the electrical heating element 21 of the cartomizer 1. It should further be noted that the electrodes 13A, 13B are formed of flat elements (shown in FIGS. 2 and 3), which are made out of plated ferrous material pressings.

FIG. 5 shows a schematic sectional view of a detail of the cartomizer 1 shown in FIG. 2 when inserted into an aerosol generating device 100. It should also be noted that the aerosol generating device 100 is provided with two electrical contacts 102 such as "pogo pins" that are configured to contact the electrodes 13A, 13B of the cartomizer 1, in particular a first portion of contact 14A of each of the electrodes 13A, 13B in order to provide the heater or electrical heating element 21 of the cartomizer 1 with electrical power. As FIG. 5 also shows, the electrodes 13A, 13B, in particular second portions of contact 14B, engage or come into contact with two magnetic elements 103 which are provided within an inner frame 102 of the aerosol generating device 100. Hence, allowing that the cartomizer 1, once inserted into the cartomizer receiving seat, is retained therein by a magnetic force of attraction acting on the electrodes 13A, 13B.

Yet, in order to provide the wire of the heater or the electrical heating element 21 with electrical power, the cartomizer 1 is further provided with lead wires 30 that electrically connect the wire or electrical heating element 21 with the electrodes 13A, 13B, in particular with a third portion of contact 14C of each of the electrodes 13A, 13B. As especially well shown in FIG. 5, the electrodes 13A, 13B are each provided with two legs, which are arranged orthogonal to each other. The first leg extends in the transversal direction of the bottom holder 12, the second leg extends in an axial direction of the cartomizer, which is perpendicular to the transversal direction of the bottom holder 12 and extends in the vertical direction in FIG. 5. It should be further noted that as shown in FIG. 4, the first and second portions 14A, 14B are arranged next to each other on the first leg extending in the transversal direction and the third portion 14C is arranged on the second leg in the axial direction of the cartomizer 1.

Figure 6:
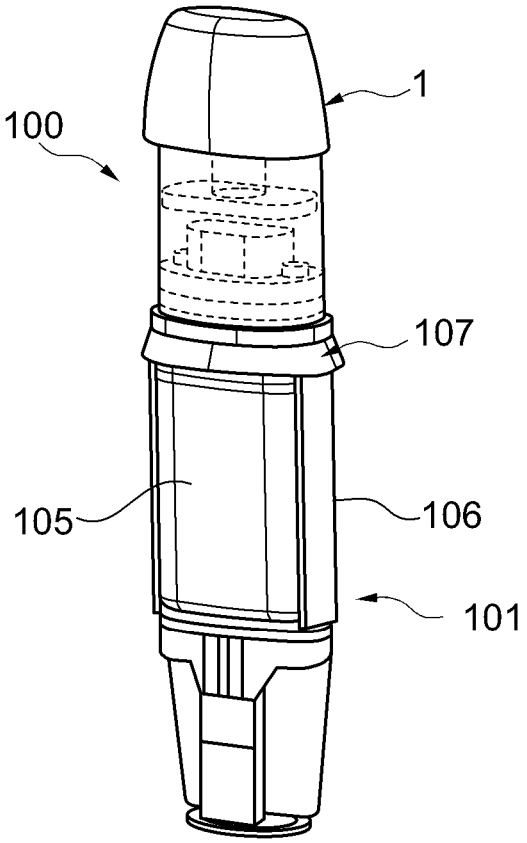
FIG. 6 shows a schematic spatial view of a whole aerosol generating device including the cartomizer according to the present invention without the outside casing.

FIG. 6 shows a schematic spatial view of a whole aerosol generating device 100 including the cartomizer 1 according to the present invention, where only the outside casing of the aerosol generating device 100 is not shown for illustrating purposes. The shown aerosol generating device 100 includes a mouthpiece which is part of the cartomizer 1 for guiding the generated vapor to a user, the cartomizer 1, a battery 105, a sealing arrangement 107, a control and power supply device 101 and an inner frame 106 for holding the battery 105 inside the device 100. It should also be noted that the aerosol generating device 100 has an elongated shape, in which a receiving cavity (cartomizer receiving seat 104) for the cartomizer 1, a power supply device, in particular the battery 105, and a main electronic circuit board are arranged in this order from a first, proximal end (mouth end) to a second, distal end. Consequently, the power supply device, in particular battery 105, is located at approximately the center of the device 100, so that it is particularly well balanced. As shown in FIG. 5, the cartomizer receiving seat 4 is provided with two electrical contacts 102 and two magnetic elements 103 transversally separated from the electrical contacts 102. When the cartomizer 1 is received in the receiving seat 104 (as shown in FIG. 5), the first portion 14A of the electrodes 13A, 13B contacts the electrical contacts 102 of the device 100 and the second portions 14B of the electrodes 13A, 13B engage or come into contact with the two magnetic elements 103 of the device 100.

REFERENCE LIST

1 Cartomizer
1A First end (of cartomizer)
1B Second end (of cartomizer)
10 Container (Shell)
11 Reservoir
12 Bottom holder
13A (Right) Electrode
13B (Left) Electrode
14A First portion of contact
14B Second portion of contact
14C Third portion of contact
15 Vaporizing chamber
16 Air inlet
17 Vapor passage
20 Vaporizing unit
21 Electrical heating element
22 Liquid transport element (Wick)
30 Lead wires
31 First sealing (Holding element)
32 Second sealing
100 Aerosol generating device
101 Control and power device
102 Electrical contact
103 Magnetic element
104 Cartomizer receiving seat
105 Battery
106 Inner frame
107 Sealing arrangement

The invention claimed is:

1. A cartomizer for an aerosol generating device, the cartomizer comprising a first end configured to engage with a control and power supply device, and a second end having a vapor outlet; the cartomizer further comprising:

a container for holding at least one reservoir configured to contain vaporizable material;

a vaporizing unit comprising an electrical heating element and a liquid transport element, wherein the liquid transport element is arranged to deliver vaporizable material from the at least one reservoir to the electrical heating element;

a bottom holder and a pair of electrodes held by the bottom holder at the first end of the cartomizer, wherein the pair of electrodes are made of a ferrous or ferro-magnetic material and are configured to extend transversally, with regard to the container of the cartomizer, at the bottom holder so that each electrode forms a first portion of contact with an electrical contact of the control and power supply device and a second portion of contact adjacent the first portion of contact to engage with a magnetic element of the control and power device.

2. The cartomizer according to claim 1, wherein the pair of electrodes extends along substantially 75% of a full transversal length of the bottom holder.

3. The cartomizer according to claim 1, wherein the bottom holder comprises an air inlet communicating with the vaporizing unit and each electrode is positioned at opposite sides of the air inlet.

4. The cartomizer according to claim 2, wherein the electrodes extend in a direction of a larger transversal dimension of the bottom holder.

5. The cartomizer according to claim 2, wherein the electrodes extend at least partially at a surface of the bottom holder.

6. The cartomizer according to claim 2, wherein the electrodes are fixed in a stationary manner in the bottom holder.

7. The cartomizer according to claim 6, wherein the electrodes are at least partially embedded in the bottom holder.

8. The cartomizer according to claim 1, wherein the electrodes are formed of flat elements.

9. The cartomizer according to claim 1, wherein the bottom holder is at least partially overmoulded on the electrodes.

10. The cartomizer according to claim 1, wherein each of the electrodes further forms a third portion of contact configured to contact lead wires providing the electrical heating element with electrical power.

11. An aerosol generating device comprising a control and power supply device comprising a cartomizer receiving seat with electrical contacts and at least one magnetic element transversally separate from the electrical contacts and a cartomizer according to claim 1, wherein when the cartomizer is received in the receiving seat of the device, the first portion of the electrodes of the cartomizer contacts the electrical contacts of the device and the second portion of at least one of the electrodes engages the at least one magnetic element of the aerosol generating device.

12. The aerosol generating device according to claim 11, wherein the receiving seat comprises a pair of electrical contacts and a pair of magnetic elements and when the cartomizer is received in the cartomizer receiving seat, the first and second portions of the electrodes of the cartomizer respectively contacts/engages one electrical contact and one magnetic element of the aerosol generating device.

13. The cartomizer of claim 5, wherein the electrodes extend at partially at a bottom outside surface of the bottom holder.

14. The cartomizer of claim 8, wherein the electrodes are formed of plated ferrous material pressings.

15. The cartomizer of claim 10, wherein the third point of contact is arranged orthogonal to the first and second portions of contact.

* * * * *